US010924836B1

(12) United States Patent
Siahaan et al.

(10) Patent No.: US 10,924,836 B1
(45) Date of Patent: Feb. 16, 2021

(54) TECHNIQUES FOR IMPROVING GLASS EARCUP DROP PERFORMANCE

(71) Applicant: Apple Inc., Cupertino, CA (US)

(72) Inventors: Edward Siahaan, San Francisco, CA (US); Jason C. Zapantis, Santa Cruz, CA (US); Christopher D. Jones, Los Gatos, CA (US); Edwin J. Corona Aparicio, San Jose, CA (US); Daniel R. Bloom, Alameda, CA (US)

(73) Assignee: Apple Inc., Cupertino, CA (US)

( * ) Notice: Subject to any disclaimer, the term of this patent is extended or adjusted under 35 U.S.C. 154(b) by 118 days.

(21) Appl. No.: 16/101,281

(22) Filed: Aug. 10, 2018

Related U.S. Application Data

(60) Provisional application No. 62/565,745, filed on Sep. 29, 2017.

(51) Int. Cl.
*H04R 1/10* (2006.01)

(52) U.S. Cl.
CPC ..... *H04R 1/1008* (2013.01); *H04R 1/1058* (2013.01); *H04R 1/1091* (2013.01)

(58) Field of Classification Search
CPC .. H04R 1/1008; H04R 1/1058; H04R 1/1091; H04R 1/10; H04R 1/24; H04R 1/403; H04R 1/26; H04R 1/1016; H04R 1/1066; H04R 1/1075; H04R 1/1033; H04R 9/063; H04R 5/02; H04R 5/033; H04R 5/0335
USPC ..... 381/371, 370, 182, 374
See application file for complete search history.

(56) References Cited

U.S. PATENT DOCUMENTS

| | | | | |
|---|---|---|---|---|
| 9,301,039 | B2 | 3/2016 | Brunner et al. | |
| 2011/0019123 | A1* | 1/2011 | Prest | C03C 19/00 349/58 |
| 2013/0188366 | A1* | 7/2013 | Russell-Clarke | H04M 1/0266 362/362 |
| 2016/0147264 | A1* | 5/2016 | Kil | G06F 1/1626 345/173 |
| 2016/0214889 | A1* | 7/2016 | Garner | B32B 17/10137 |
| 2016/0216943 | A1* | 7/2016 | Welti | G06F 1/163 |
| 2017/0022092 | A1* | 1/2017 | DeMartino | G06F 1/1626 |
| 2019/0086959 | A1* | 3/2019 | Seino | G06F 1/1656 |

FOREIGN PATENT DOCUMENTS

WO 2017030736 A1 2/2017

* cited by examiner

*Primary Examiner* — Ahmad F. Matar
*Assistant Examiner* — Sabrina Diaz
(74) *Attorney, Agent, or Firm* — Kilpatrick Townsend & Stockton LLP

(57) ABSTRACT

An earpiece includes a glass earcup having an outer exposed surface, an inner surface, and an edge extending around the perimeter of the glass earcup. The earpiece further includes an upper enclosure to which the glass earcup is laminated, and a protective coating lining the edge of the glass earcup.

12 Claims, 7 Drawing Sheets

TECHNIQUES FOR IMPROVING GLASS EARCUP DROP PERFORMANCE

CROSS-REFERENCES TO RELATED APPLICATIONS

This application claims the benefit of U.S. provisional patent application No. 62/565,745, filed Sep. 29, 2017, which is incorporated by reference.

BACKGROUND

Headphones have been in use for over 100 years, but the design and performance of the earpieces that are held against the ears of a user by a headband have remained somewhat static. Thus, there is a need for improved design and performance of the headphone earpieces.

SUMMARY

Various techniques for improving the drop performance of an earphone, in particular along the edge of the earphone's glass earcup, are described in this disclosure. In accordance with some embodiments, an earpiece includes a glass earcup having an outer exposed surface, an inner surface, and an edge extending around the perimeter of the glass earcup. The earpiece further includes an upper enclosure to which the glass earcup is laminated, and a protective coating lining the edge of the glass earcup.

In accordance with other embodiments, an earpiece includes a glass earcup includes an outer exposed surface, an inner surface, and edges extending around the perimeter of the glass earcup. The earpiece further includes an upper enclosure to which the glass earcup is laminated, and a textile extending around the glass earpiece and to the edge of the glass earcup and having a wall facing the edge of the earcup.

In accordance with other embodiments, a glass earcup includes an outer exposed surface, an inner surface, and edges extending around the perimeter of the glass earcup. The Earpiece further includes an upper enclosure to which the glass earcup is laminated. The edge of the glass earcup is inset from an outer edge of the upper enclosure.

In accordance with other embodiments, a glass earcup includes an outer exposed surface, an inner surface, and edges extending around the perimeter of the glass earcup. The earpiece further includes an upper enclosure to which the glass earcup is laminated. The upper enclosure includes a trim portion extending up along the edge of the glass earcup.

In accordance with other embodiments, a glass earcup having an outer exposed surface, an inner surface, and edges extending around the perimeter of the glass earcup. The glass earcup includes an upper compression layer extending along its outer surface and an inner compression layer extending along its inner surface, wherein the upper compression layer extends deeper into the glass earcup than the lower compression layer. The glass earcup further includes a barrier layer extending along the inner surface of the glass earcup, and a protective layer extending along a surface of the edge of the glass earcup.

DETAILED DESCRIPTION OF THE INVENTION

Figure 1B:
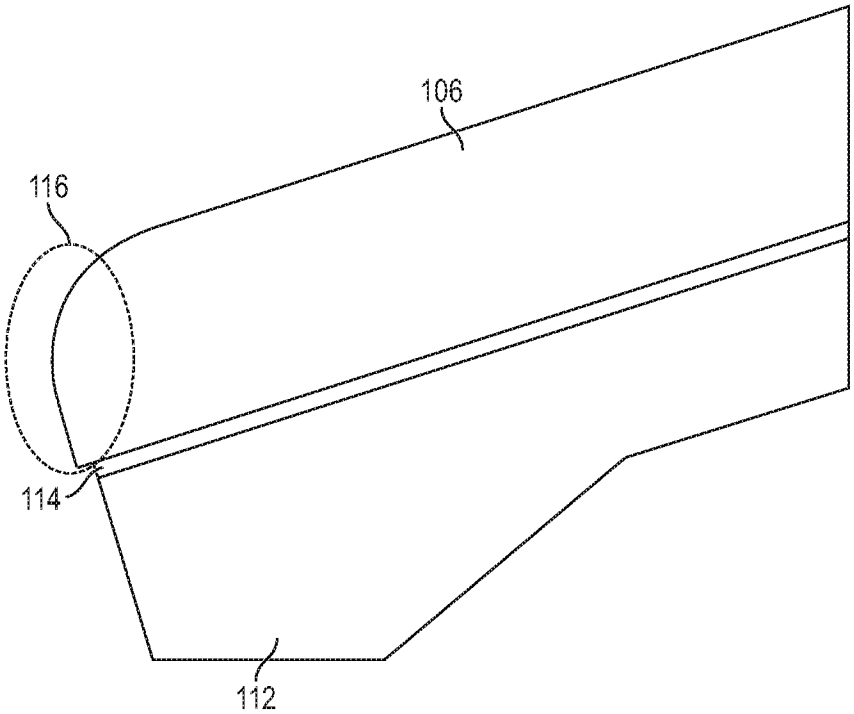
FIG. 1B is a magnified view of an edge area of the earpiece in FIG. 1A.
Figure 1A:
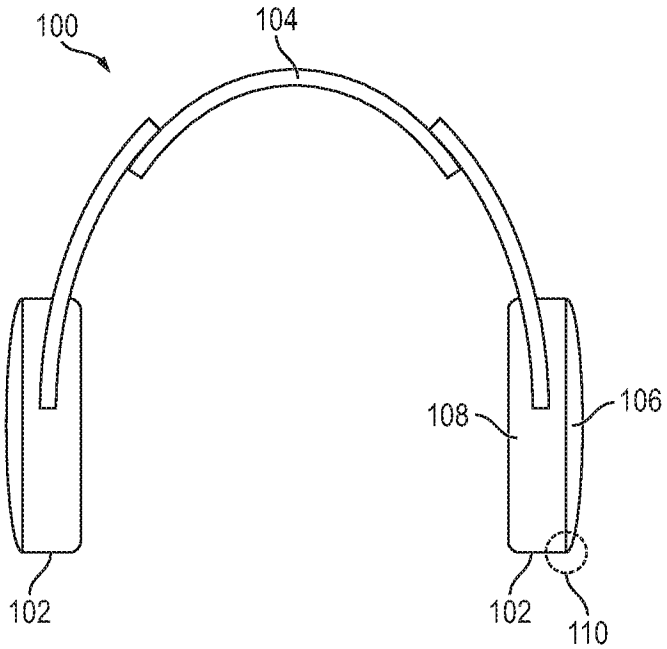
FIG. 1A is a perspective view of a headphone.

FIG. 1A shows a perspective view of headphone 100 having two earpieces 102 held together by headband 104. Each earpiece 102 includes earcup 106 and cushion frame and soft goods 108 extending around the earpiece. Earcup 106 may include a touch sensor area that can be configured to allow a user to manipulate settings and the playback of media. For example, the touch sensor could be configured to receive and process multiple gestures corresponding to commands such as changes in volume, next/previous track, pause, stop, and the like. Earcup 106 may be made from various materials such as polycarbonate and/or glass. Polycarbonate is advantageous in that it is shatter resistant, however, it is prone to scratching. Glass is advantageous in that it is more scratch resistant and cosmetically more appealing than polycarbonate, however, it is more prone to shattering than polycarbonate. This disclosure is primarily directed to earpiece designs, and in particular, to various techniques for improving the drop performance of headphones with earpieces that include glass earcups.

FIG. 1B is a magnified cross section view at edge area 110 of earpiece 102 in FIG. 1A. Glass earcup 106 is laminated to earpiece upper enclosure 112 by adhesive material 114. Adhesive material 114 may also have anti-shatter properties to help prevent glass shards from flying out in the event glass earcup 106 hits a rough surface, such as asphalt, along its exposed outer surface. As can be seen, glass earcup 106 extends past and overhangs earpiece enclosure 112, and thus edge areas 116 of glass earcup 106 are exposed. This manner of making the glass edge visible may be cosmetically preferred to a design where the glass edge is covered by, for example, a plastic trim. While this configuration of glass earcup 106 is esthetically pleasing and adhesive coating 114 can help prevent glass shards from flying out, it has been found that the FIG. 1B configuration of glass earcup 106 is particularly susceptible to shattering along its edge area 116 if, for example, the headphone is dropped and hits the ground along edge 116 of glass earcup 106. A number of techniques are described in this disclosure for improving the drop performance of the glass earcup while preserving the cosmetic appeal of the earpiece.

Figure 2C:
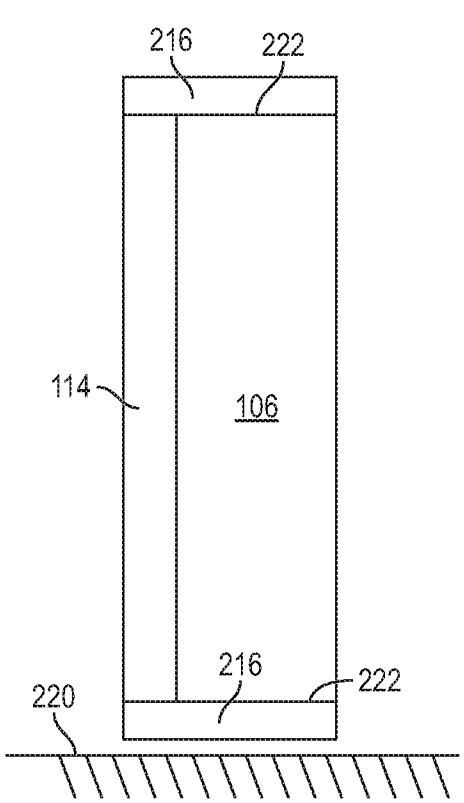
FIGS. 2A-2C illustrate a technique for improving the drop performance of the glass earcup by lining the outer edge of the glass earcup with a protective coating.
Figure 2B:
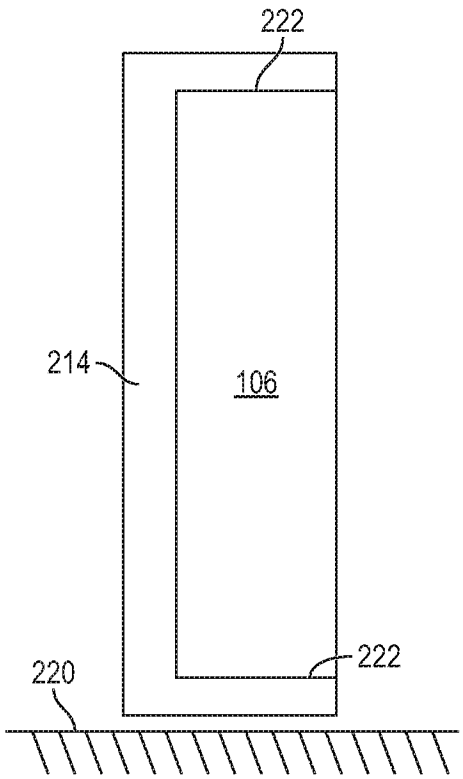
Figure 2A:
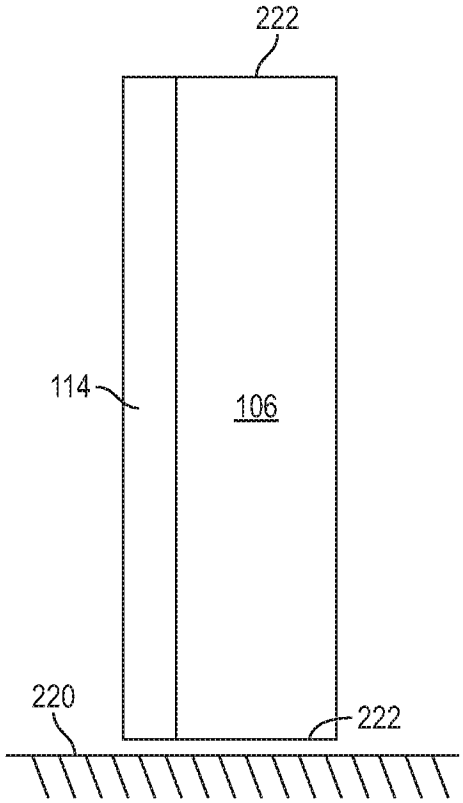

FIGS. 2A-2C illustrate a technique for improving the drop performance of the glass earcup by lining the outer edge of the glass earcup with a protective coating. FIG. 2A corresponds to the configuration in FIG. 1B. Coating 114 in FIG. 2A, similar to that in FIG. 1B, covers only the enclosed inner surface of glass earcup 106, and thus, peripheral edges 222 of glass earcup 106 are exposed and susceptible to shattering in the event the earpiece impacts ground 220 along peripheral edges 222 of glass earcup 106. FIG. 2B shows protective coating 214 lining edges 222 of glass earcup 106, and as such serves to protect peripheral edges 222 of glass earcup 106 from shattering. FIG. 2C shows another embodiment where peripheral edges 222 of glass earcup 106 are coated with protective layer 216 independent of coating 114 that lines the inner surface of glass earcup 106. Protective layer 216 may be any optically clear material, such as a polymer and/or epoxy, that adds thickness along edges 222 of glass earcup 106.

Figure 3:
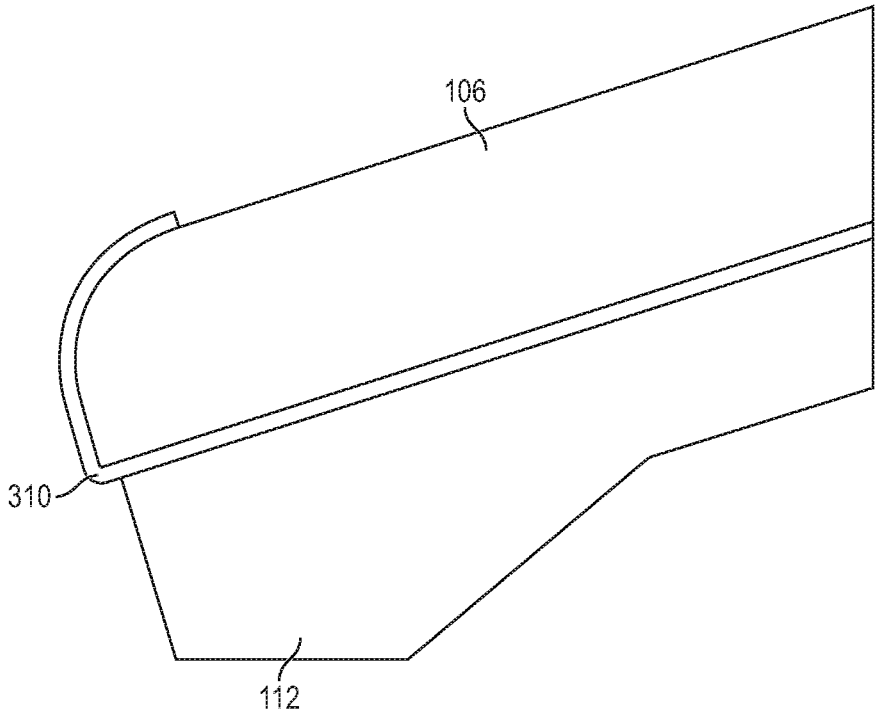
FIG. 3 shows an application of the technique illustrated in FIGS. 2B-2C in an earpiece.

FIG. 3 shows how the technique illustrated in FIGS. 2B-2C may be applied to an earpiece. As can be seen, protective coating 310 extending along the enclosed inner surface of glass earcup 106 may be extended up and around the peripheral edge of glass earcup 106. Protective coating 310 may be a single layer similar to that shown in FIG. 2B, or may comprise two layers, one extending along the inner surface of glass earcup 106 and another one extending along the peripheral edge of glass earcup 106, similar to that shown in FIG. 2C. In some variations, protective coatings 114, 214, 216, 310 may have a thickness in the range of 0.05 to 2 mm, and may be optically clear. In general, coatings 114, 214, 216, 310 may be from any material suitable for protecting glass edges 222 from shattering in the event glass earcup 106 impacts a hard object or drops to the ground along its peripheral edge. For example, any or all of protective layers 114, 214, 216, 310 may be from any material that is resistant to shatter or cracking when it comes into contact with sharp objects or rough surfaces, such as asphalt. The protective layers, may be, for example, from plastic, polymer or organic material. While any or all of coatings 114, 214, 216, 310 may be optically clear for esthetic purposes, any or all of them may be opaque depending on the design goals. For example, in embodiments where the glass edge may be less visible, for example, due to a plastic trim (such as trim 612A in FIG. 6), then opaque material, such as, ink or paint, may be used to coat the glass edges for even better drop performance.

In FIGS. 2A-2C, any or all of coating layers 114, 214, 216 may be formed by a masking and spraying process. For example, in FIG. 2A, edges 222 of glass earcup may be masked during the spraying process for forming coating layer 114. In FIG. 2B, edges 222 are not masked during the spraying process, thus allowing a coating layer 214 to be formed along the enclosed inner surface and the peripheral edges of glass earcup 106.

Figure 4B:
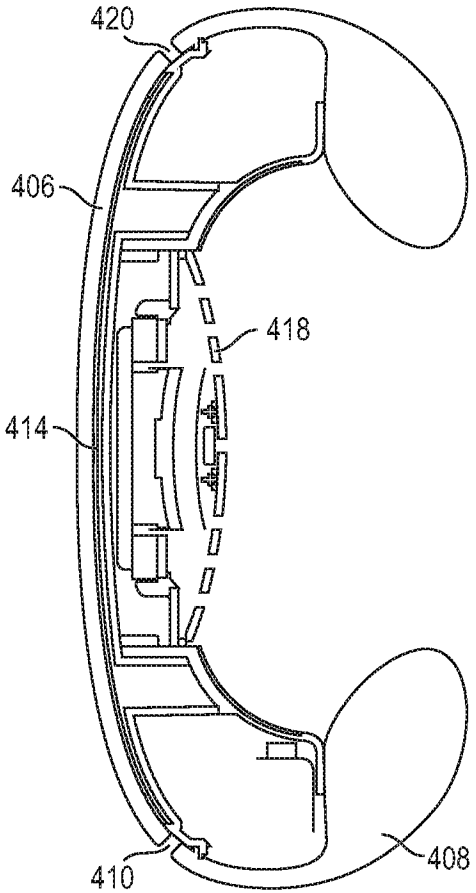
FIGS. 4A-4B show another technique for improving the drop performance of the glass earcup by extending the earpiece textile up to the edge of the glass earcup.
Figure 4A:
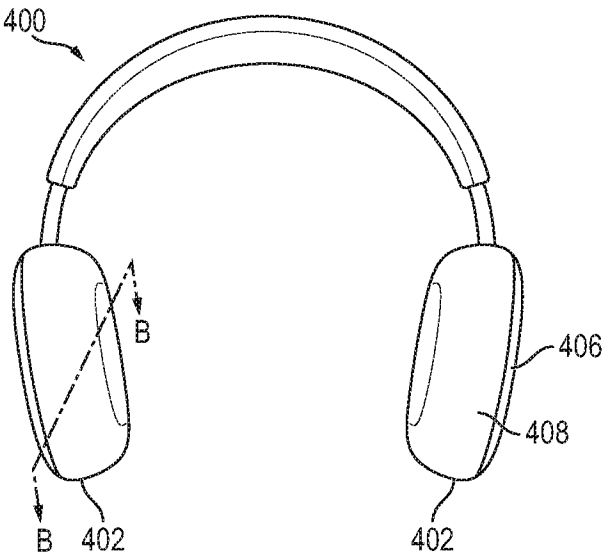

FIGS. 4A and 4B show another technique for improving the drop performance of the glass earcup by extending the earpiece textile up to the edge of the glass earcup. FIG. 4A is a perspective view of earphone 400, and FIG. 4B shows a cross section view of earpiece 402 along cutline B-B in FIG. 4A. Glass earcup 406 may be plate-shaped and may have a circular outline, a square outline with rounded corners or a rectangular outline with rounded corners. Glass earcup 406 and extends along an exterior of earpiece 402, with its outer surface visible. A thin layer 414 coats the inner surface of earcup 406, and may be from material that would keep glass shards from flying out in the event glass earcup 406 is shattered due to a drop. Dashed line 418 outlines a plastic enclosure in which the internal components of the headset (e.g., electronic components such as the speaker, inverter, and the like) are housed. Cushion frame and soft goods 408 extends around the perimeter of earpiece 402. Both glass earcup 406 and cushion frame and soft goods 408 may be fastened to upper enclosure 410 of earpiece 402. Upper enclosure 410 may be from hard plastic. Advantageously, cushion frame and soft goods 408 is extended all the way to outer edges of glass earcup 406 so that the foam cushion in cushion frame and soft goods 408 protects peripheral edges of glass earcup 406 against impact. As shown, a small cosmetic gap 420 may be provided between the edge of glass earcup 406 and extended portion of cushion frame and soft goods 408 so that the glass edge is visible.

While the foam cushion provides added protection for the edges of glass earcup against impact, because of the flexibility of the foam cushion, which may be a soft textile, and the presence of gap 420, the foam cushion can potentially move out of the way without absorbing the impact if the earphone drops on the ground at just the right angle. Combining the technique illustrated in FIGS. 4A, 4B with, for example, the technique illustrated in FIGS. 2B, 2C, 3 where the edges of the glass earcup are coated with optically clear protective layer 310 (FIG. 3) would provide added protection in the event the earphone is dropped at an angle such that the foam cushion is moved out of the way without absorbing the impact.

Figure 5:
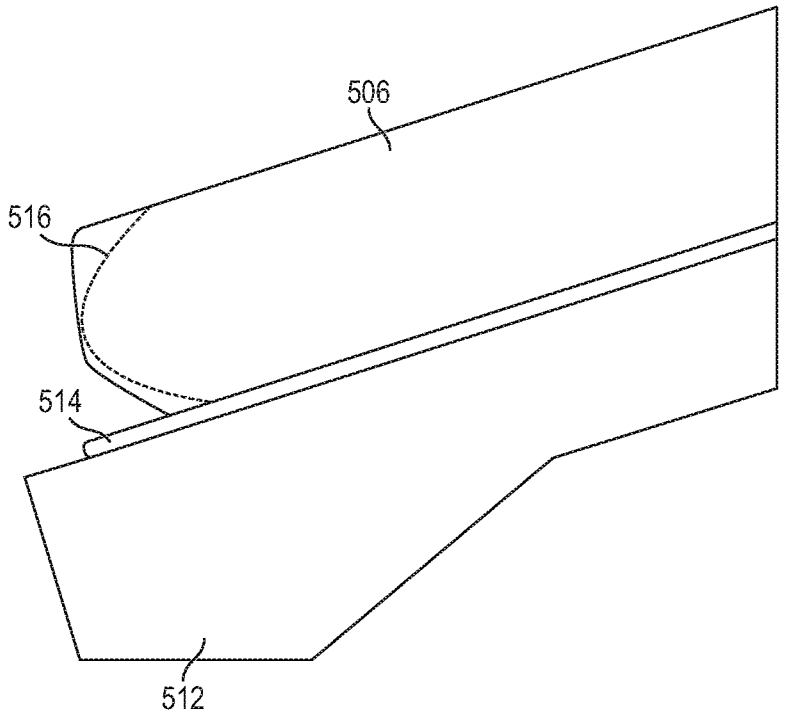
FIG. 5 shows another technique for improving the drop performance of the glass earcup by forming the glass earcup so that its edge is inset relative to an edge of the upper enclosure of the earpiece.

FIG. 5 shows another technique for improving the drop performance of the glass earcup. In this embodiment, peripheral edges of glass earcup 506 are inset relative to the underlying earpiece enclosure 512 so that outer regions of earpiece enclosure 512 become exposed. With outer regions of earpiece enclosure 512 exposed, in the event of a drop along peripheral edges of the earpiece, the exposed outer portions of earpiece enclosure 512 glass earcup 506 serve to protect peripheral edges of glass earpiece 506. While FIG. 5 shows peripheral edges of glass earcup 506 having straight edges, earcup 506 can be manufactured to have a bullnose or rounded peripheral edge, as depicted by the rounded dashed line 516. In some variations, coating 514 may be extended up and around the peripheral edges of glass earcup 506 for added protection of the glass edge against impact.

Figure 6:
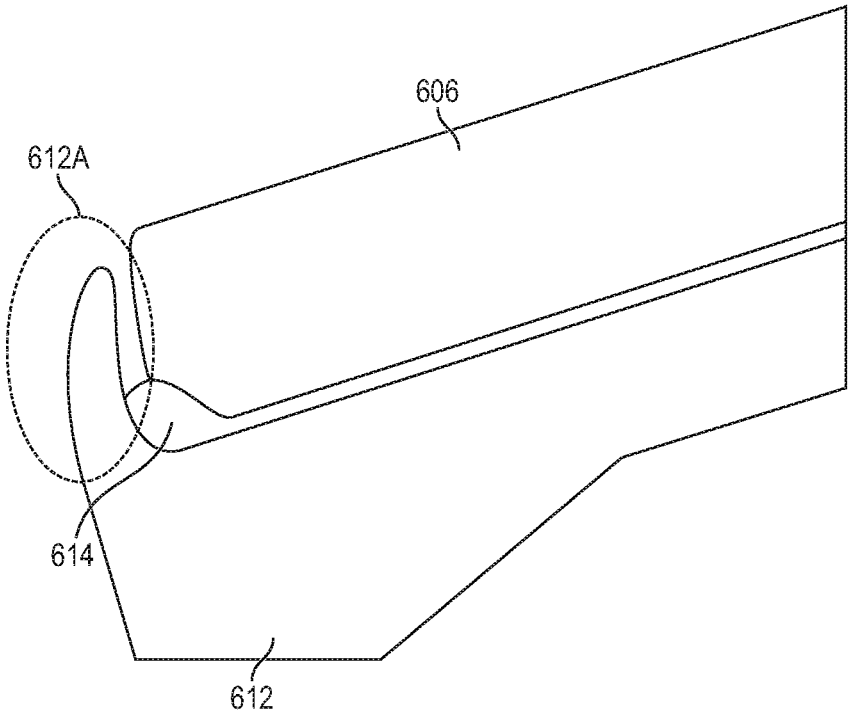
FIG. 6 shows another technique for improving the drop performance of the glass earcup by extending a trim portion around the glass edge.
Figure 7A:
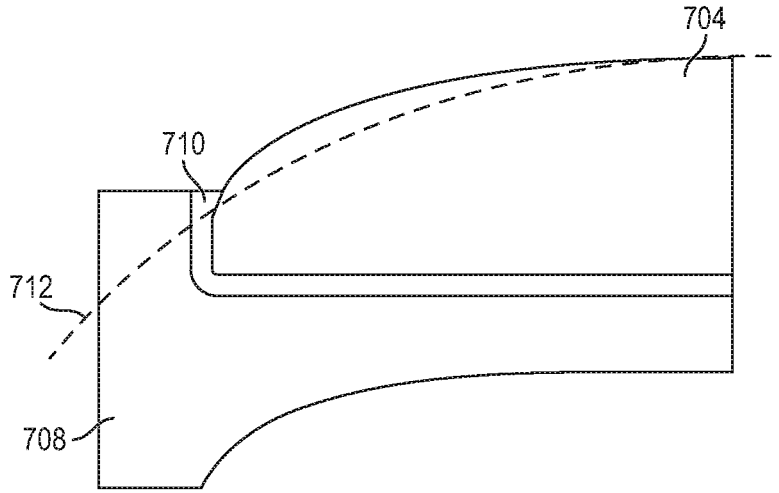
FIGS. 7A-7B illustrate a variation of the technique in FIG. 6 where an earpiece with a cosmetic edge is formed.
Figure 7B:
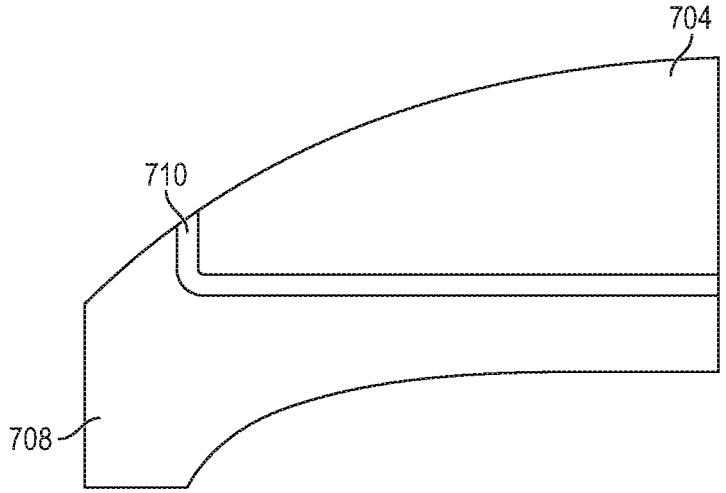

FIG. 6 shows another technique for improving the drop performance of the glass earcup by extending a trim portion around the glass edge. In this embodiment, earpiece enclosure 612 extends up along peripheral edge of glass earcup 606 to form protective plastic trim 612A around earcup 606. In the event of a drop along an edge of earcup 606, extended trim 612A protects the peripheral edge of glass earcup 606. In FIG. 6, a gap is present between extended portion 612A and glass earcup 606 edge so that the earcup edge around the perimeter of the earcup is visible. In some variations, plastic trim 612A may be designed to abut the edges of glass earcup 606. Alternatively, gap filler 614 may be used to completely or partially fill the gap between plastic trim 612A and glass earcup 606. FIGS. 7A and 7B show a variation of the technique in FIG. 6 where an earpiece with a rounded cosmetic edge is formed. In FIG. 7A, glass earcup 704 is thicker than normal, and earpiece enclosure 708 extends up around the perimeter of earcup 704. Earpiece enclosure 708 and earcup 704 are assembled together, with gap filler 710 filling the gap between them. Earpiece enclosure 708, earcup 704 and gap filler 710 may then be simultaneously cut and polished, for example, using co-machining, to the dashed line 712 in FIG. 7A. This results in the upper surfaces of earpiece enclosure 708, earcup 704 and gap filler 710 to become flush with one another, and together form a rounded edge for the earpiece, as shown in FIG. 7B.

Figure 8:
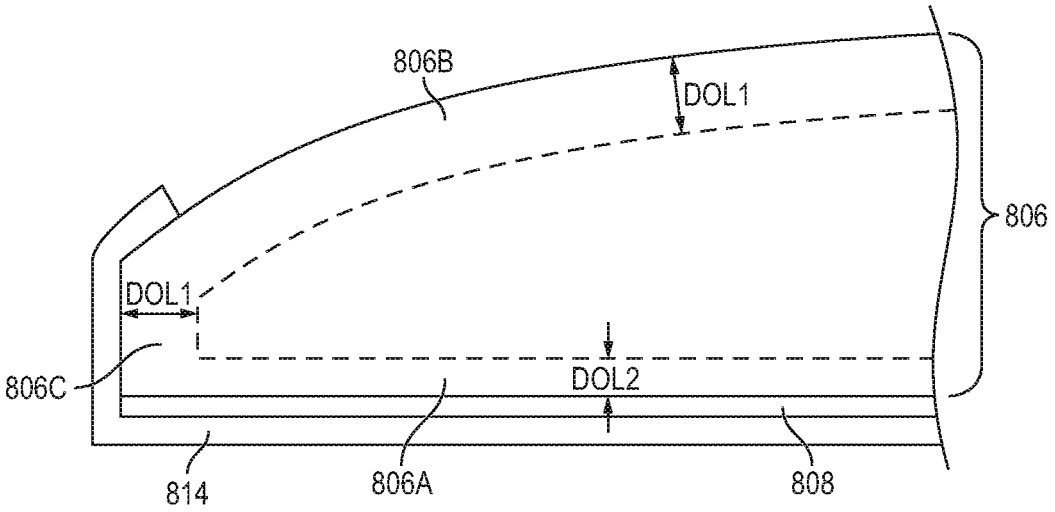
FIG. 8 is a cross section view of a glass earcup that has been treated using asymmetrical chemical strengthening process.
Figure 9:
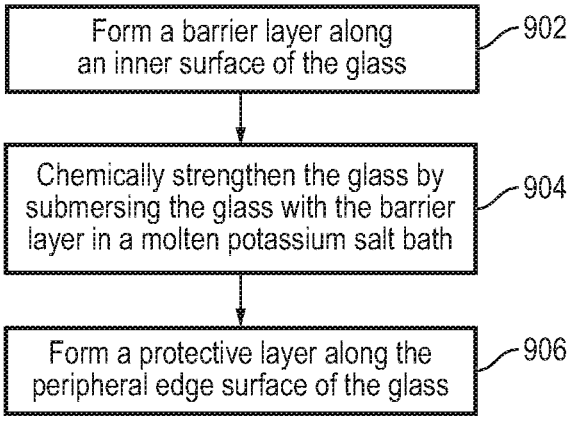
FIG. 9 is a flow chart showing the steps of the asymmetrical chemical strengthening process used in treating the glass earcup in FIG. 8.

Another technique for improving the drop performance of the glass earcup involves engineering the glass earcup itself using asymmetrical chemical strengthening. This technique will be described with reference to FIGS. 8 and 9. FIG. 8 is a cross section view of a portion of glass earcup 806, and FIG. 9 is a flow chart outlining a simplified process flow for the asymmetrical chemical strengthening process.

In FIG. 8, asymmetric chemical strengthening is used to obtain a deeper compression layer or depth of layer DOL1 along outer surface layer 806B of earcup glass 806, and a shallower compression layer or depth of layer DOL2 along inner surface layer 806A of glass 806. The "outer" surface of earcup 806 corresponds to the exposed, externally accessible surface of earcup glass 806, and the "inner" surface corresponds to the surface of glass earcup 806 that is enclosed and faces a user's ear when the earphone is worn by the user. Compression layer and depth of layer are used interchangeably to refer to a chemically strengthened surface layer of the glass.

Generally, the central tension of glass is proportional to the chemical strengthening along outer surface layer 806B times the depth of layer DOL1 along outer surface layer 806B plus the chemical strengthening along inner surface region 806A times the depth of layer DOL2 along inner surface region 806A. Glass shatters on smooth surfaces, such as granite, are typically a result of the glass bending. To reduce the failure rate in smooth surface impacts, a high chemical strengthening along inner surface layer 806A of glass earcup 806 is needed. On the other hand, glass shatters on rough surfaces, such as asphalt, are typically a result of puncturing the glass. To reduce the failure rate in rough surface impacts, a high depth of layer along outer surface layer 806B is needed. The asymmetric chemical strengthening process, described in more detail below, allows the glass to have a deep DOL (DOL1) along outer surface layer 806B where it is prone to impact, and a high chemical strengthening along inner surface layer 806A to ensure improved bending performance. Thus, asymmetric chemical strengthening advantageously allows optimizing the depth of layer and the chemical strengthening parameters to improve the drop performance on soft surfaces such as granite and on rough surfaces such as asphalt. In some variations, the chemical strengthening process may be carried out so that the DOL along edge surface layer 806C of earcup 806 has a similar depth as DOL1, and thus is more resistant to shattering when impacting a rough surface.

The chemical strengthening on the surface of glass is fairly linear through the compressive zone down to an inner zone where there is tension in the glass. Glass fails when it hits, for example, asphalt, and the impact penetrates through the compressive zone, reaching the central tension zone. Thus, by increasing the depth of layer along the glass surface that is prone to impact, the compressive zone is extended thus reducing the chances of an impact penetrating through the compressive zone and reaching the central tension zone. However, most glasses are limited by how much tension can be put into them. If too much tension is put into the glass, the glass becomes unsafe in that it can shatter with such force that glass shards fly in different directions. This limit on the tension balances the amount of compression that may be built into the outer and inner surface layers of the glass. The amount of compressive stress thus needs to be reduced if the tension is to be reduced. However, reduced depth of layer is undesirable in that an impact with a rough surface can more easily penetrate through the DOL. The asymmetric DOL approach addresses these competing interests by reducing the DOL along inner surface layer 806A of the glass where the surface is not prone to impact, thus allowing a deeper DOL to be formed along outer surface layer 806B of the glass which is prone to external impact.

Glass is typically chemically strengthened by submersing the glass in a molten potassium salt bath. As such, all sides of the glass are chemically strengthened in a uniform manner, and thus the same compressive stress and depth of layer is obtained along all surface layers of the glass. In order to achieve different depths of layer along different glass surfaces, an asymmetric chemical strengthening process may be used. In this process, depicted by the flow chart in FIG. 9, barrier layer 808 (FIG. 8) is formed along the glass inner surface where a shallower depth of layer DOL2 is desired. This step corresponds to step 902 in FIG. 9. Next, in step 904, glass 806 with barrier layer 808 on its inner surface is submersed in a molten potassium salt bath for a predetermined period of time. Barrier layer 808 may comprise silica or any other material that slows the ion exchange in the glass surface layer that the barriers layer covers, and that can withstand high temperatures when the glass is submersed in the molten potassium salt bath. The ion exchange process involves replacement of sodium ions in glass surface layers with potassium ions from the bath solution. Barrier layer 808 serves to slow down the ion exchange process by slowing diffusion of potassium ions into the glass surface layer it covers. This results in formation of a shallower DOL2 along inner surface layer 806A covered by barrier layer 808, and deeper DOLL along all other uncovered surface layers. The DOL thickness is directly dependent on how long the glass is submersed in the potassium salt bath.

In step 906, after the glass is removed from the potassium salt bath, protective layer 814 (e.g., a soft polymer coating that can also serve as an anti-shatter layer) may be formed along the inner surface of glass 806 and optionally alongside surfaces of glass 806. Protective layer 814 may be formed using a coating process. For example, glass 806 may be sprayed with a liquid polymer with surfaces that are not to receive the protective layer being covered with a masking layer during the spray process. For example, to form protective layer 814 as shown in FIG. 8, the masking layer would cover only the outer surface of glass 806. Protective layer 814 lining the edges of glass 806 together with the deeper DOL1 alongside surface layer 806C serve to significantly improve the drop performance of glass 806 in case of an edge impact. In some embodiments, protective layer 814 has a thickness in the range of 100-200 μm, and DOL1 has a thickness in the range of 150-200 μm. These two thicknesses combine along the edges of glass 806 to prevent cracks from reaching the central tension region in the event the glass is dropped on its edge on a rough surface such as asphalt.

The asymmetric chemical strengthening described above may be combined with any one or more of the other techniques for improving the drop performance of the glass earcup described above. For example, the asymmetric chemical strengthening can be combined with the plastic trim techniques illustrated in FIGS. 6, 7A, 7B. In such embodiment, the deeper DOL1 along the edges of glass 806 may not be needed, in which case barrier layer 808 may be extended along the edges of the glass during chemical strengthening so that deeper DOL is formed only along outer surface region 806B of glass 806

While certain combinations of the various techniques for improving the drop performance of the glass earcup are described above, any one or more of the techniques may be combined together depending on the design goals. While the above techniques are described in the context of a glass earcup, the application of these techniques is not limited to headphone earcups. The above techniques may be applied to any type of device, such as smart phones and smart watches, with a glass component that may be shatter prone.

Although the invention has been described with respect to specific embodiments, it will be appreciated that the invention is intended to cover all modifications and equivalents within the scope of the following claims.

What is claimed is:

1. An earpiece comprising:

an enclosure defining an interior volume, the enclosure having a front surface with one or more holes formed there through, a rear surface opposite the front surface and an outer annular periphery between the front and rear surfaces;

a speaker disposed within a central portion of the interior volume and positioned to direct sound through the one or more holes formed in the front surface;

an annular cushion frame coupled to the enclosure;

a glass plate having an outer exposed surface that defines a first portion of an outer periphery of the earpiece, an inner surface, and an annular edge extending between the outer exposed and inner surfaces around a perimeter of the glass plate;

a protective adhesive coating disposed between and coupling the inner surface of the glass plate to the rear surface of the enclosure; and a textile coupled to the cushion frame and surrounding the outer annular periphery of the enclosure to form a second portion of the outer periphery of the earpiece adjacent to the first portion, the textile further extending to but spaced apart from the annular edge of the glass plate forming a gap between the textile and the annular edge.

2. The earpiece of claim 1 wherein the protective adhesive coating comprises anti-shatter material.

3. The earpiece of claim 1 wherein the enclosure is made from plastic.

4. The earpiece of claim 1 wherein the protective adhesive coating lines the inner surface and the annular edge of the glass plate.

5. The earpiece of claim 4 wherein the protective adhesive coating extends from the annular edge of the glass plate along a portion of the outer exposed surface.

6. The earpiece of claim 1 wherein the textile includes a foam cushion.

7. A pair of headphones comprising:

first and second earpieces; and a headband coupled between the first and second earpieces;

wherein each of the first and second earpieces comprises:

an enclosure defining an interior volume, the enclosure having a front surface with one or more holes formed there through, a rear surface opposite the front surface and an outer annular periphery between the front and rear surfaces;

a speaker disposed within a central portion of the interior volume and positioned to direct sound through the one or more holes formed in the front surface;

an annular cushion frame coupled to the enclosure;

a glass plate having an outer exposed surface that defines a first portion of an outer periphery of the earpiece, an inner surface, and an annular edge extending between the outer exposed and inner surfaces around a perimeter of the glass plate;

a protective adhesive coating disposed between and coupling the inner surface of the glass plate to the rear surface of the enclosure; and a textile coupled to the cushion frame and surrounding the outer annular periphery of the enclosure to form a second portion of the outer periphery of the earpiece adjacent to the first portion, the textile further extending to but spaced apart from the annular edge of the glass plate forming a gap between the textile and the annular edge.

8. The pair of headphones set forth in claim 7 wherein the enclosure of each of the first and second earpieces is made from plastic.

9. The pair of headphones set forth in claim 7 wherein, for each of the first and second earpieces, the protective adhesive coating lines the inner surface and the annular edge of the glass plate.

10. The pair of headphones set forth in claim 7 wherein, for each of the first and second earpieces, the protective adhesive coating extends from the annular edge of the glass plate along a portion of the outer exposed surface.

11. The pair of headphones set forth in claim 7 wherein, for each of the first and second earpieces, the textile includes a foam cushion.

12. The pair of headphones set forth in claim 7 wherein, for each of the first and second earpieces, the protective adhesive coating comprises anti-shatter material.

* * * * *